US011091823B2

(12) United States Patent
Chae et al.

(10) Patent No.: US 11,091,823 B2
(45) Date of Patent: Aug. 17, 2021

(54) MAGNESIUM ALLOY SHEET AND MANUFACTURING METHOD THEREOF

(71) Applicant: POSCO, Pohang-si (KR)

(72) Inventors: Young-Wook Chae, Pohang-si (KR); Jun Ho Park, Pohang-si (KR); Jae Joong Kim, Pohang-si (KR); Oh-Duck Kwon, Pohang-si (KR)

(73) Assignee: POSCO, Pohang-si (KR)

( * ) Notice: Subject to any disclaimer, the term of this patent is extended or adjusted under 35 U.S.C. 154(b) by 144 days.

(21) Appl. No.: 16/472,966

(22) PCT Filed: Dec. 12, 2017

(86) PCT No.: PCT/KR2017/014570
§ 371 (c)(1),
(2) Date: Jun. 24, 2019

(87) PCT Pub. No.: WO2018/117521
PCT Pub. Date: Jun. 28, 2018

(65) Prior Publication Data

US 2019/0368010 A1 Dec. 5, 2019

(30) Foreign Application Priority Data

Dec. 23, 2016 (KR) ..... 10-2016-0178364

(51) Int. Cl.

| | |
|---|---|
| ***C22C 23/02*** | (2006.01) |
| ***B21B 1/46*** | (2006.01) |
| ***B21B 3/00*** | (2006.01) |
| ***C22F 1/06*** | (2006.01) |

(52) U.S. Cl.
CPC ..... *C22C 23/02* (2013.01); *B21B 1/463* (2013.01); *B21B 3/003* (2013.01); *C22F 1/06* (2013.01)

(58) Field of Classification Search
CPC ..... C22C 23/02; C22C 23/04; C22F 1/06
See application file for complete search history.

(56) References Cited

FOREIGN PATENT DOCUMENTS

| | | | |
|---|---|---|---|
| CN | 102712969 | A | 10/2012 |
| CN | 102899545 | A | 1/2013 |
| CN | 104404329 | A | 3/2015 |
| CN | 104745906 | A | 7/2015 |
| JP | 2010-156007 | A | 7/2010 |
| JP | 2013-007068 | A | 1/2013 |
| JP | 2016-079451 | A | 5/2016 |
| KR | 10-2008-0085662 | A | 9/2008 |
| KR | 10-0860091 | B1 | 9/2008 |
| KR | 10-2012-0081628 | A | 7/2012 |
| KR | 10-2016-0011136 | A | 1/2016 |
| KR | 10-2016-0036297 | A | 4/2016 |
| KR | 10-2016-0075143 | A | 6/2016 |
| WO | 2006/105594 | A1 | 10/2006 |

OTHER PUBLICATIONS

Chinese Office Action dated Oct. 12, 2020 issued in Chinese Patent Application No. 201780078970.5 (with English translation).
Japanese Office Action dated Jul. 28, 2020 issued in Japanese Patent Application No. 2019-533046.
Extended European Search Report issued in corresponding European Patent Application No. 17884531.9, dated Sep. 23, 2019.
International Search Report and Written Opinion dated Mar. 30, 2018 issued in International Patent Application No. PCT/KR2017/014570 (with partial English translation).

*Primary Examiner* — Jessee R Roe
(74) *Attorney, Agent, or Firm* — Morgan, Lewis & Bockius LLP

(57) ABSTRACT

An exemplary embodiment of the present invention relates to a magnesium alloy sheet and a manufacturing method thereof. According to an exemplary embodiment of the present invention, a magnesium alloy sheet including 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % of the magnesium alloy sheet, may be provided.

13 Claims, 4 Drawing Sheets

Comparative Example 1

Comparative Example 2

Example 1 Example 2 Example 3

Comparative Example 7

Comparative Example 8

MAGNESIUM ALLOY SHEET AND MANUFACTURING METHOD THEREOF

CROSS-REFERENCE OF RELATED APPLICATIONS

This application is the U.S. National Phase under 35 U.S.C. § 371 of International Patent Application No. PCT/KR2017/014570, filed on Dec. 12, 2017, which in turn claims the benefit of Korean Application No. 10-2016-0178364, filed on Dec. 23, 2016, the entire disclosures of which applications are incorporated by reference herein.

TECHNICAL FIELD

An exemplary embodiment of the present invention relates to a magnesium alloy sheet and a manufacturing method thereof.

BACKGROUND ART

A magnesium alloy is a lightweight material having high specific strength, and is rapidly spreading in fields requiring weight reduction for interior and exterior panels of a vehicle, mobile phones, notebook computers, and computers. However, the magnesium alloy rapidly corrodes when exposed to the atmosphere or moisture. Therefore, expensive surface treatment is required for use in the above-mentioned application, and the application field is limited due to such a feature.

In order to fundamentally solve this problem, studies have been actively carried out to improve corrosion resistance of the magnesium alloy itself. Particularly, researches for improving the corrosion resistance of magnesium through the addition of Sb, As, or Y have been known. However, As or Sb improves the corrosion resistance of pure magnesium, but its effect is insufficient and toxic. In the case of the Y element, the effect of improving the corrosion resistance is excellent when added alone. However, it is necessary to add a large amount, and the corrosion rate is similar to that of an M1A alloy compared with the added amount, and the price competitiveness is poor, such that practical application to mass production process is limited.

DISCLOSURE

The present invention has been made in an effort to provide a magnesium alloy sheet and a manufacturing method thereof.

According to an exemplary embodiment of the present invention, a magnesium alloy sheet may include 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % of the magnesium alloy sheet.

The magnesium alloy sheet may satisfy Relational Expression 1.

$$2[Y] \leq [Ca] \qquad \text{Relational Expression 1}$$

Herein, the [Y] and [Ca] indicate wt % of each component.

The magnesium alloy sheet may satisfy Relational Expression 2.

$$[Ca]+[Y] \leq 2.5 \text{ wt \%} \qquad \text{Relational Expression 2}$$

Herein, the [Y] and [Ca] indicate wt % of each component.

The magnesium alloy sheet may further include 0.5 wt % or less of Mn (excluding 0 wt %) with respect to the total of 100 wt % of the magnesium alloy sheet.

The magnesium alloy sheet may further include 0.004 to 0.01 wt % of Be with respect to the total of 100 wt % of the magnesium alloy sheet.

The other inevitable impurities may be 0.005 wt % or less of Fe, 0.01 wt % or less of Si, 0.01 wt % or less of Cu, 0.01 wt % or less of Ni, or a combination thereof.

According to another embodiment of the present invention, a manufacturing method of a magnesium alloy sheet may include: preparing a casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof; homogenizing heat treatment the casting material; and rolling the homogenized heat-treated casting material to manufacture the magnesium alloy sheet.

The casting material may satisfy Relational Expression 1 in the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof.

$$2[Y] \leq [Ca] \qquad \text{Relational Expression 1}$$

Herein, the [Y] and [Ca] indicate wt % of each component.

Specifically, the casting material may satisfy Relational Expression 2.

$$[Ca]+[Y] \leq 2.5 \text{ wt \%} \qquad \text{Relational Expression 2}$$

Herein, the [Y] and [Ca] indicate wt % of each component.

The casting material may further include 0.5 wt % or less of Mn (excluding 0 wt %) with respect to a total of 100 wt % thereof.

The homogenizing heat treatment of the casting material may be performed in a temperature range of 350 to 500° C.

Specifically, the homogenizing heat treatment may be performed for 4 to 48 hours.

The rolling of the homogenized heat-treated casting material to manufacture the magnesium alloy sheet may include: forming a rolled material by rolling the homogenized heat-treated casting material; and manufacturing the magnesium alloy sheet by buffing the rolled material.

According to the exemplary embodiment of the present invention, corrosion resistance may be improved by controlling components and a composition of the magnesium alloy sheet.

MODE FOR INVENTION

Figure 1:
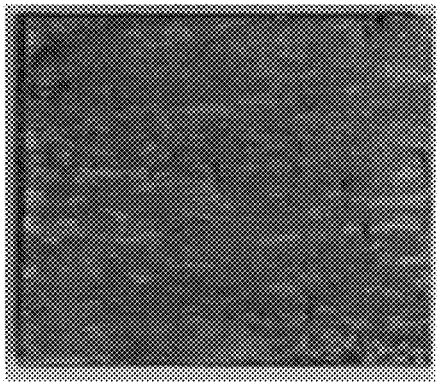
FIG. 1 illustrates surfaces of alloys after corrosion resistance comparison experiments according to Comparative Examples 1 and 2.
Figure 1:
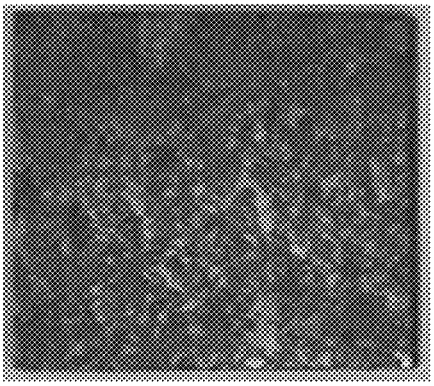

The advantages and features of the present invention and the methods for accomplishing the same will be apparent from the exemplary embodiments described hereinafter with reference to the accompanying drawings. However, the present invention is not limited to the exemplary embodiments described hereinafter, but may be embodied in many different forms. The following exemplary embodiments are provided to make the disclosure of the present invention complete and to allow those skilled in the art to clearly understand the scope of the present invention, and the present invention is defined only by the scope of the appended claims. Throughout the specification, the same reference numerals denote the same elements.

In some exemplary embodiments, detailed description of well-known technologies will be omitted to prevent the disclosure of the present invention from being interpreted ambiguously. Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising" will be understood to imply the inclusion of stated elements but not the exclusion of any other elements. Further, as used herein, the singular forms "a", "an", and "the" are intended to include the plural forms as well, unless the context clearly indicates otherwise.

According to an exemplary embodiment of the present invention, a magnesium alloy sheet may include 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % of the magnesium alloy sheet.

Specifically, the magnesium alloy sheet may further include 0.5 wt % or less of Mn (excluding 0 wt %) with respect to the total of 100 wt % of the magnesium alloy sheet.

Hereinafter, reasons for limiting components and composition of the magnesium alloy sheet are as follows.

Al generally plays a role in increasing strength of the Mg alloy and improving a main composition thereof. As a content of Al increases, a high concentration Al oxide layer is formed on a surface of the Mg alloy to improve corrosion resistance Therefore, when aluminum is less than 1.0 wt %, it may not cause an effect of improving strength and corrosion resistance, while when it is 10.5 wt % or more, a $Mg_{17}Al_{12}$ phase as a process phase is greatly increased to reduce a tensile property, so that the effect may be induced. Accordingly, aluminum may be included in the above range.

Zn increases the strength of the Mg alloy by a solid solution strengthening effect, and acts as a barrier in the grain boundary when segregated in grain boundaries to start corrosion.

Therefore, when zinc is less than 1.0 wt %, it may not cause an effect of improving strength and corrosion resistance, while when it is more than 2.0 wt %, a coarse process phase may cause effects of not only reducing the mechanical properties but also inhibiting the corrosion resistance. Accordingly, zinc may be included in the above range.

Ca is segregated at grain boundaries of the Mg alloy to serve to improve the moldability by a solute dragging effect.

When calcium is less than 0.1 wt %, the solute dragging effect may be insignificant, and when it exceeds 2.0 wt %, castability of a molten metal may be reduced to generate hot cracking. In addition, since die sticking with a mold increases, an effect such as a decrease in elongation may be caused. Accordingly, calcium may be included in the above range.

Similar to Fe, Y serves to control impurities that deteriorate the corrosion resistance of the magnesium alloy. Specifically, it plays a role in suppressing local galvanic corrosion.

Therefore, when yttrium is less than 0.03 wt %, the effect of improving the corrosion resistance may be insignificant. On the other hand, when yttrium is more than 1.0 wt %, excessive intermetallic precipitates may be formed, to cause effects of deteriorating corrosion resistance, rolling property, and moldability. Accordingly, yttrium may be included in the above range.

Be serves to improve the corrosion resistance of the magnesium alloy by suppressing hydrogen bonding. Be may be included in an amount of 0.002 to 0.02 wt %. Specifically, Be may be included in an amount of 0.004 to 0.01 wt %.

More specifically, when beryllium is less than 0.002 wt %, the effect of improving the corrosion resistance may be insignificant. On the other hand, when it is more than 0.02 wt %, the elongation of the Mg alloy may significantly decrease. Accordingly, beryllium may be included in the above range.

Mn may be combined with the Fe impurity which deteriorates the corrosion resistance in a Mg alloy, and forms an intermetallic compound to suppress micro-galvanic corrosion.

Accordingly, when manganese is contained in an amount of 0.5 wt % or less (excluding 0 wt %), the above-described role or effect may be expected.

The magnesium alloy sheet may satisfy Relational Expression 1.

$$2[Y] \leq [Ca] \qquad \text{Relational Expression 1}$$

In this case, the [Y] and [Ca] indicate wt % of each component.

Specifically, a coarse Ca content fraction in the process may be reduced by controlling the composition of calcium and yttrium as Relational Expression 1, thereby expecting an effect of controlling micro-galvanic corrosion. Accordingly, it is possible to lower a corrosion rate of the magnesium alloy sheet.

The magnesium alloy sheet may satisfy Relational Expression 2.

$$[Ca]+[Y] \leq 2.5 \text{ wt } \% \qquad \text{Relational Expression 2}$$

In this case, the [Y] and [Ca] indicate wt % of each component.

Specifically, excessive precipitation may be prevented by controlling the composition of calcium and yttrium as shown in Relational Expression 2, thereby preventing reduction of corrosion resistance and ductility.

The other inevitable impurities may be 0.005 wt % or less of Fe, 0.01 wt % or less of Si, 0.01 wt % or less of Cu, 0.01 wt % or less of Ni, or a combination thereof. However, the present invention is not limited thereto.

According to another embodiment of the present invention, a manufacturing method of a magnesium alloy sheet may include: preparing a casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof; homogenizing heat treatment the casting material; and rolling the homogenized heat-treated casting material to manufacture the magnesium alloy sheet.

First, the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof may be performed. Specifically, the preparing of the casting material may further include 0.5 wt % or less of Mn (excluding 0 wt %) with respect to the total of 100 wt % of the casting material.

Specifically, Be may be included in an amount of 0.004 to 0.01 wt %.

The other inevitable impurities may be 0.005 wt % or less of Fe, 0.01 wt % or less of Si, 0.01 wt % or less of Cu, 0.01 wt % or less of Ni, or a combination thereof.

A reason for limiting components and composition in the preparing of the casting material is the same as the reason for limiting the components and composition of the magnesium alloy sheet, and thus a description thereof will be omitted.

Specifically, the casting material may satisfy Formula 1.

$$2[Y] \leq [Ca] \quad \text{Formula 1}$$

In this case, the [Y] and [Ca] indicate wt % of each component.

Specifically, the casting material may satisfy Formula 2.

$$[Ca]+[Y] \leq 2.5 \text{ wt \%} \quad \text{Formula 2}$$

In this case, the [Y] and [Ca] indicate wt % of each component.

In addition, the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof, may include:

forming a molten alloy containing Al, Zn, and the balance of Mg and other inevitable impurities; adding source materials of Ca, Y, and Be or a master alloy of Ca, Y, and Be into the molten alloy; and forming the casting material by casting the molten alloy containing the source materials of Ca, Y, and Be or the master alloy of Ca, Y, and Be.

Specifically, the forming of the molten alloy containing Al, Zn, and the balance Mg and other inevitable impurities may be performed by using a graphite crucible.

The casting material having the aforementioned components and composition and the magnesium alloy sheet may be obtained by the adding of the source materials of Ca, Y, and Be or the master alloy of Ca, Y, and Be into the molten alloy.

Specifically, a mixed gas of SF6 and $N_2$ may be applied to an upper portion of the molten alloy containing the source materials of Ca, Y, and Be or the master alloy of Ca, Y, and Be.

Specifically, oxidation of the molten alloy may be prevented by applying the mixed gas to the upper portion of the molten alloy. Accordingly, the molten alloy may be prevented from contacting the atmosphere.

Hereafter, the forming of the casting material by casting the molten alloy containing the source materials of Ca, Y, and Be or the master alloy of Ca, Y, and Be may be performed.

Specifically, it may be cast by using a steel mold. More specifically, the casting material may be formed through mold casting without using a protective gas.

However, the present invention is not limited thereto, and any casting method capable of manufacturing a magnesium alloy sheet such as sand casting, gravity casting, pressure casting, continuous casting, thin plate casting, die casting, precision casting, spray casting, or semi-solidification casting is possible.

Thereafter, the homogenizing heat treatment of the casting material may be performed.

Specifically, the casting material may be homogenized heat-treated in a temperature range of 350 to 500° C.

Specifically, the homogenizing heat treatment may be performed for 4 to 48 hours.

More specifically, it is possible to eliminate defects generated during casting by performing the homogenizing heat treatment of the cast material in the temperature range of 350 to 500° C.

Thereafter, the rolling of the homogenized heat-treated casting material to manufacture the magnesium alloy sheet may be performed.

Specifically, the rolling of the homogenized heat-treated casting material to manufacture the magnesium alloy sheet may include: forming a rolled material by rolling the homogenized heat-treated casting material; and manufacturing the magnesium alloy sheet by buffing the rolled material.

Specifically, the homogenized heat-treated casting material may be ground before the forming of the rolled material by rolling the homogenized heat-treated casting material.

Thereafter, the ground cast material may be rolled to form the rolled material.

Specifically, the casting material may be rolled in a temperature range of 100 to 300° C.

The casting material may be rolled at a rate of 1 to 200 mpm.

A reduction ratio per roll may be in a range of 10 to 30%/pass.

When the rolling is performed under the above conditions, a sheet having a desired thickness may be obtained.

Herein, in this specification, the reduction ratio indicates a difference between a thickness of the material before passing through the rolling roll during rolling and a thickness of the material after passing through the rolling roll, divided by the thickness of the material before passing through the rolling roll, and then multiplied by 100.

Finally, buffing of the rolled material to manufacture the magnesium alloy sheet may be performed.

Specifically, the rolled material may be buffed using a silica roller. In this case, silica rollers of #400 to 1200 may be used.

Specifically, the silica rollers may have a smaller number as silica has a larger size and a rougher roughness. Accordingly, the silica rollers of #400, 800, and 1200 may be used in that order to perform the buffing.

Hereinafter, the details will be described with reference to examples.

The following examples are illustrative of the present invention, and are not intended to limit the scope of the present invention.

Examples

First, an AZ31 ingot was melted, and then a molten alloy was prepared by adding a Mg—Ca master alloy, a Mg—Y master alloy, an Al—Be master alloy, or a combination thereof to the above melted ingot. In this case, the master alloys were added such that components and compositions of the following Table 1 were satisfied. Specifically, the ingot was melted by using a graphite crucible. Specifically, a mixed gas of SF6 and N2 was applied to an upper portion of the molten alloy.

Thereafter, the molten alloy was cast using a steel mold. Specifically, a casting material may be formed through mold casting without using a protective gas. The thus-formed casting material had a sheet form having a width of 140 mm, a length of 220 mm, and a thickness of 10 mm.

Hereinafter, the cast material was subjected to homogenizing heat treatment at 450° C. for 4 hours.

Then, a grinding process of a total of 4 mm was performed on opposite surfaces of the homogenized heat-treated cast material in a thickness direction by 2 mm each.

Thereafter, the processed sheet was rolled under conditions of a temperature of 200° C., a rolling rate of 5 mpm, and a reduction rate per rolling of 15%/pass, thereby forming a rolled material having a final thickness of 1.2 mm.

Finally, the opposite surfaces of the rolled material were buffed with silica rollers. In this case, the silica rollers of #400, 800, and 1200 were used in that order.

Comparative Examples

In the comparative examples, an AZ31 ingot was melted, and then a molten alloy was prepared by adding a Mg—Ca master alloy, a Mg—Y master alloy, an Al—Be master alloy, or a combination thereof to the above melted ingot. In this case, the master alloys were added such that components and compositions of the following Table 1 were satisfied. However, pure magnesium (99.5 wt %) was prepared in Comparative Example 1.

Thereafter, a magnesium alloy sheet was manufactured under the same conditions and in the same manner as in the foregoing examples.

Experimental Examples

Corrosion Resistance Test of Magnesium Alloy Sheet

The corrosion resistance of the magnesium alloy sheets manufactured in the above-described examples and comparative examples was measured and is shown in Table 1 below. A measurement method of the corrosion resistance measurement method is as follows.

The above-mentioned magnesium alloy sheet was cut into a length of 95 mm and a width of 70 mm. Thereafter, the sheet was immersed in 1 L of a NaCl solution (3.5 wt %) at room temperature for 20 hours to form an oxide on a surface of the sheet.

Subsequently, the sheet on which the oxide was formed was immersed in a following solution for 1 min. Specifically, the oxide-formed sheet was salt-immersed in a solution obtained by containing 100 g of anhydrous chromic acid and 10 g of silver chromate in 1 L of distilled water at 90° C. Accordingly, the oxide of the surface of the sheet was removed.

As a result, the corrosion rate was deduced from a weight of the sheet before oxide formation and the weight of the sheet after oxide removal. Specifically, the corrosion rate was calculated by dividing a weight loss of the sheet after oxide removal by an area of a specimen, density, and a salt deposition time.

Corrosion rate=(initial weight of specimen−weight after oxide removal)/(specimen area×density× salt deposition time)

TABLE 1

| Division | Alloy components and composition (wt %) | | | | | | | Corrosion rate |
|---|---|---|---|---|---|---|---|---|
| | Al | Zn | Mn | Ca | Y | Be | Mg | (mm/y) |
| Comparative Example 1 | — | — | — | — | — | — | Bal. | 2.40 |
| Comparative Example 2 | 3 | 1 | 0.3 | — | — | 0.001 | Bal. | 3.51 |
| Example 1 | 3 | 1 | 0.3 | 0.5 | 0.2 | 0.005 | Bal. | 0.26 |
| Example 2 | 6 | 1 | 0.3 | 0.5 | 0.1 | 0.005 | Bal. | 0.46 |

TABLE 1-continued

| Division | Alloy components and composition (wt %) | | | | | | | Corrosion rate |
|---|---|---|---|---|---|---|---|---|
| | Al | Zn | Mn | Ca | Y | Be | Mg | (mm/y) |
| Example 3 | 9 | 1 | 0.15 | 0.4 | 0.1 | 0.005 | Bal. | 0.62 |
| Comparative Example 3 | 3 | 1 | 0.3 | 0.5 | — | — | Bal. | 2.79 |
| Comparative Example 4 | 3 | 1 | 0.3 | — | 0.2 | — | Bal. | 1.54 |
| Comparative Example 5 | 3 | 1 | 0.3 | 0.5 | — | 0.005 | Bal. | 3.74 |
| Comparative Example 6 | 3 | 1 | 0.3 | — | 0.2 | 0.005 | Bal. | 1.41 |
| Comparative Example 7 | 2 | — | 0.3 | 0.5 | 0.2 | 0.001 | Bal. | 2.62 |
| Comparative Example 8 | — | 1 | — | 0.5 | 0.2 | — | Bal. | 3.67 |
| Comparative Example 9 | — | — | — | 0.5 | 0.3 | — | Bal. | 1.32 |
| Comparative Example 10 | — | — | — | 0.3 | 0.5 | — | Bal. | 3.90 |
| Comparative Example 11 | 3 | 1 | 0.3 | 0.3 | 0.3 | 0.005 | Bal. | 1.16 |

The corrosion rate depending on the components and composition of the magnesium alloy sheet is as shown in Table 1, which can also be confirmed in the drawings.

FIG. 1 illustrates surfaces of alloys after corrosion resistance comparison experiments according to Comparative Examples 1 and 2.

Specifically, Comparative Example 1 is pure magnesium (99.5 wt % Mg), and Comparative Example 2 is the AZ31 alloy as a conventional magnesium alloy. More specifically, as shown in FIG. 1, corrosion oxides occurred on the entire surface of the sheet after a corrosion resistance comparison test in Comparative Examples 1 and 2. As a result, it was visually confirmed that the surface of the plate was changed to a dark color.

On the other hand, in Examples 1 to 3, which all satisfy the composition ranges according to the exemplary embodiment of the present invention, the corrosion rate is remarkably lower than that of the comparative examples. This may be a result of addition of Ca, Y and Be.

Figure 2:
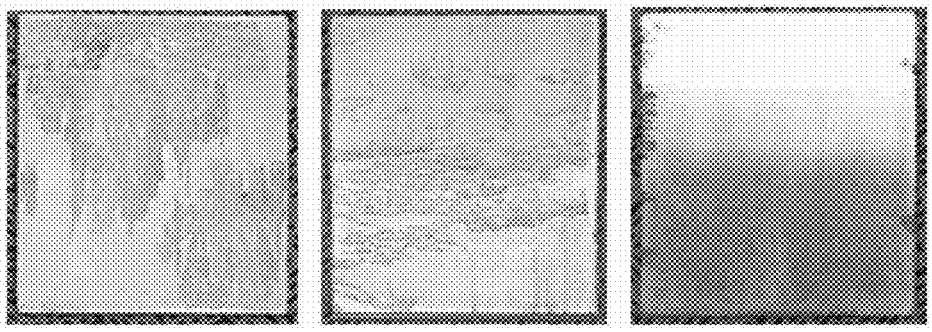
FIG. 2 illustrates a surface of an alloy after corrosion resistance comparison tests according to Example 1 to 3.

This may also be confirmed through FIG. 2.

FIG. 2 illustrates a surface of an alloy after corrosion resistance comparison tests according to Examples 1 to 3.

As illustrated in FIG. 2, in Examples 1 to 3, it was confirmed that, unlike Comparative Examples 1 and 2, the corrosion rate was reduced, and thus the formation of a surface corrosion oxide was reduced. As a result, a surface color of the magnesium metal could be visually confirmed.

Specifically, Comparative Example 3 did not contain Y and Be as compared with Example 1. In the case of Comparative Example 4, Ca and Be were not contained as compared with Example 1. Comparative Example 5 did not contain Y as compared with Example 1. In the case of Comparative Example 6, Ca was not contained as compared with Example 1.

In other words, in the case of Comparative Examples 3 to 6, the magnesium alloy sheet was manufactured by containing only one or two of Ca, Y, and Be.

As a result, it was confirmed that the corrosion rates of Comparative Examples 3 to 6 were lower than that of Example 1.

In particular, the corrosion rate of Comparative Example 5, which did not contain Y, was the lowest and the corrosion rate of Comparative Example 3 which did not contain Y and Be was next.

As a result, it can be seen that the corrosion resistance is improved most effectively when Y is added. However, it can be seen that the corrosion rate and the degree of surface corrosion are much lower than those of Examples 1 to 3 in which Ca, Y, and Be are all added.

In addition, in the case of Comparative Examples 7 and 8 containing only one of Al or Zn, it can be seen that the corrosion rate is faster than those of Examples 1 to 3 which contain all of the above components.

Figure 3:
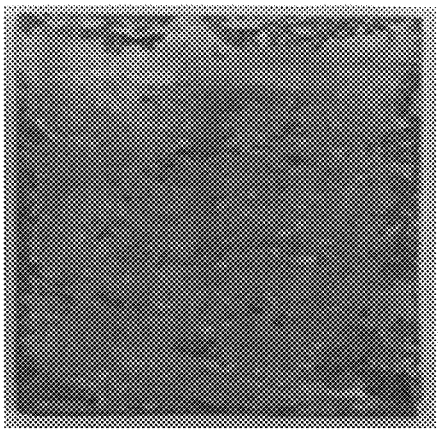
FIG. 3 illustrates surfaces of alloys after corrosion resistance comparison experiments according to Comparative Examples 1 and 8.
Figure 3:
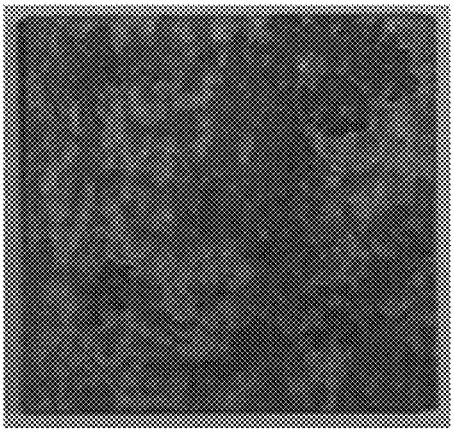

This may also be confirmed through FIG. 3.

FIG. 3 illustrates surfaces of alloys after corrosion resistance comparison experiments according to Comparative Examples 7 and 8.

As illustrated in FIG. 3, it was confirmed that a large number of surface oxide layers were formed in Comparative Examples 7 and 8 as in Comparative Examples 1 and 2 described above. As a result, it was visually confirmed that the surface of the alloy sheet was changed to a dark color.

It is also understood that Examples 1 to 3 of the present invention all satisfy the following Relational Expression 1.

$$2[Y] \leq [Ca] \qquad \text{Relational Expression 1}$$

In this case, the [Y] and [Ca] indicate wt % of each component.

However, as in Comparative Examples 9 to 11, even when Relational Expression 1 is satisfied, it can be confirmed that the corrosion rate is faster than those in Examples 1 to 3.

Figure 4:
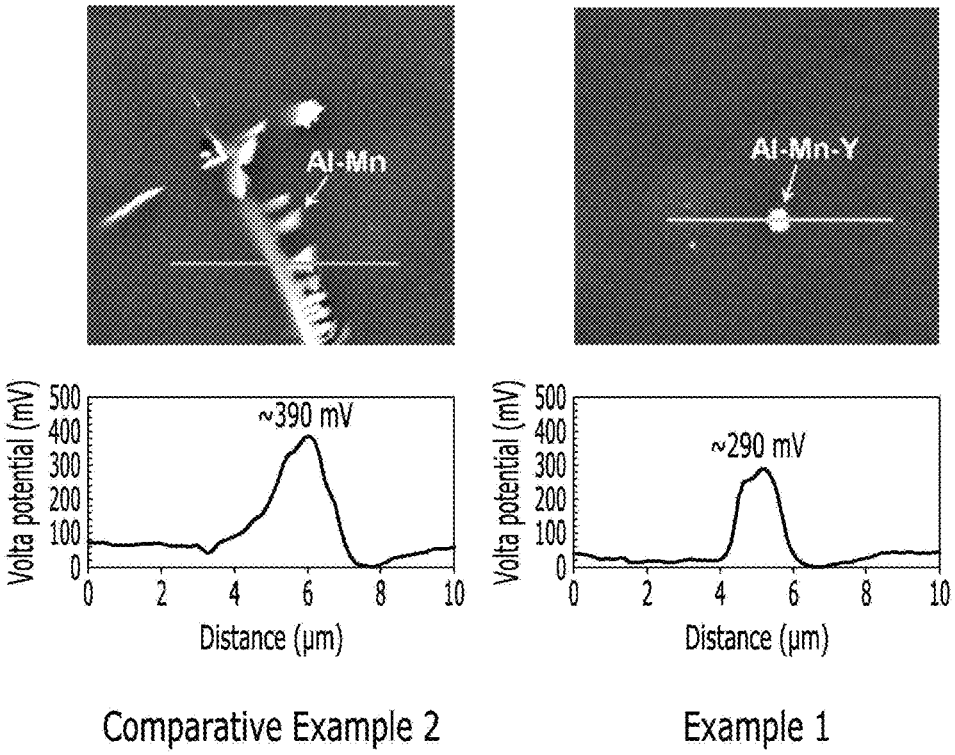
FIG. 4 illustrates volta potentials of an Al—Mn phase measured according to Comparative Example 2 and Example 1.

FIG. 4 illustrates volta potentials of an Al—Mn phase measured according to Comparative Example 2 and Example 1.

As illustrated in FIG. 4, it is confirmed that a difference in volta potentials relative to a matrix phase of an Al—Mn—Y phase formed with Y addition is relatively low, as compared with an Al—Mn phase formed in Comparative Example 2. This means that micro-galvanic corrosion caused by a potential difference between an Al—Mn second phase and a Mg matrix phase may be reduced by Y addition.

As a result, according to the examples of the present invention, it is possible to suppress the micro-galvanic corrosion by the Y addition.

While the exemplary embodiments of the present invention have been described hereinbefore with reference to the accompanying drawings, it will be understood by those skilled in the art that various changes in form and details may be made thereto without departing from the technical spirit and essential features of the present invention.

Therefore, it is to be understood that the above-described exemplary embodiments are for illustrative purposes only, and the scope of the present invention is not limited thereto. The scope of the present invention is determined not by the above description, but by the following claims, and all changes or modifications within the spirit, scope, and equivalents of claims should be construed as being included in the scope of the present invention.

The invention claimed is:

1. A magnesium alloy sheet comprising 1.0 to 10.5 wt % of Al, 0.1 to 2.0 wt % of Zn, 0.1 to 2.0 wt % of Ca, 0.03 to 1.0 wt % of Y, 0.004 to 0.02 wt % of Be, and a balance of Mg and inevitable impurities, with respect to a total of 100 wt % thereof.

2. The magnesium alloy sheet of claim 1, wherein
the magnesium alloy sheet satisfies Relational Expression 1:

$$2[Y] \leq [Ca] \qquad \text{Relational Expression 1}$$

wherein the [Y] and [Ca] indicate wt % of each component.

3. The magnesium alloy sheet of claim 2, wherein
the magnesium alloy sheet satisfies Relational Expression 2:

$$[Ca]+[Y] \leq 2.5 \text{ wt \%} \qquad \text{Relational Expression 2}$$

wherein the [Y] and [Ca] indicate wt % of each component.

4. The magnesium alloy sheet of claim 3, further comprising
0.5 wt % or less of Mn (excluding 0 wt %) with respect to the total of 100 wt % of the magnesium alloy sheet.

5. The magnesium alloy sheet of claim 4, further comprising
0.004 to 0.01 wt % of Be with respect to the total of 100 wt % of the magnesium alloy sheet.

6. The magnesium alloy sheet of claim 5, wherein
the other inevitable impurities may be 0.005 wt % or less of Fe, 0.01 wt % or less of Si, 0.01 wt % or less of Cu, 0.01 wt % or less of Ni, or a combination thereof.

7. A manufacturing method of a magnesium alloy sheet, the method comprising:
preparing a casting material containing 1.0 to 10.5 wt % of Al, 0.1 to 2.0 wt % of Zn, 0.1 to 2.0 wt % of Ca, 0.03 to 1.0 wt % of Y, 0.004 to 0.02 wt % of Be, and a balance of Mg and inevitable impurities, with respect to 100 wt % thereof;
homogenizing heat treatment the casting material; and
rolling the homogenized heat-treated casting material to manufacture the magnesium alloy sheet.

8. The manufacturing method of claim 7, wherein
the casting material satisfies Relational Expression 1 in the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to the total of 100 wt % thereof:

$$2[Y] \leq [Ca] \qquad \text{Relational Expression 1}$$

wherein the [Y] and [Ca] indicate wt % of each component.

9. The manufacturing method of claim 8, wherein
the casting material satisfies Relational Expression 2 in the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof:

$$[Ca]+[Y] \leq 2.5 \text{ wt \%} \qquad \text{Relational Expression 2}$$

wherein the [Y] and [Ca] indicate wt % of each component.

10. The manufacturing method of claim 9, further comprising
0.5 wt % or less of Mn (excluding 0 wt %) with respect to a total of 100 wt % of the casting material in the preparing of the casting material containing 1.0 to 10.5 wt % of Al, 0.1 to 2.0 wt % of Zn, 0.1 to 2.0 wt % of Ca, 0.03 to 1.0 wt % of Y, 0.002 to 0.02 wt % of Be, and a balance of Mg and inevitable impurities, with respect to a total of 100 wt % thereof.

11. The manufacturing method of claim 7, wherein
in the homogenizing heat treatment of the casting material,
the homogenizing heat treatment is performed in a temperature range of 350 to 500° C.

12. The manufacturing method of claim 7, wherein
in the soaking of the casting material, the homogenizing heat treatment is performed for 4 to 48 hours.

13. The manufacturing method of claim 12, wherein the rolling of the homogenized heat-treated casting material to manufacture the magnesium alloy sheet includes:

forming a rolled material by rolling the homogenized heat-treated casting material; and manufacturing the magnesium alloy sheet by buffing the rolled material.

* * * * *